United States Patent [19]

Stoor

Best Available Copy

[11] 4,123,915

[45] Nov. 7, 1978

[54] DEFROST TIMER HAVING SELECTABLE DEFROST TIME

[75] Inventor: Jon D. Stoor, Manitowoc, Wis.

[73] Assignee: AMF Incorporated, White Plains, N.Y.

[21] Appl. No.: 797,280

[22] Filed: May 16, 1977

[51] Int. Cl.[2] ..... F25D 21/08; H01H 7/08

[52] U.S. Cl. ..... 62/234; 200/38 B; 200/38 D

[58] Field of Search ..... 62/234, 155, 157; 200/38 B, 38 C, 38 D

[56] References Cited

U.S. PATENT DOCUMENTS

| | | | |
|---|---|---|---|
| 2,711,456 | 6/1955 | Goodhouse et al. | 62/234 X |
| 3,327,074 | 6/1967 | Wiser | 200/3 |
| 4,056,948 | 11/1977 | Goodhouse | 62/155 |

*Primary Examiner*—William E. Wayner
*Attorney, Agent, or Firm*—George W. Price; John H. Gallagher

[57] ABSTRACT

A selectable cycle defrost timer having two timing cams and two timing switches that are switched from first to second switch positions by the respective cams. The two cams rotate different numbers of times in a given time period, but the two switches are simultaneously in their second switch positions just once each given time period. Interconnection means between the two switches permits the timer to be connected into a defrost control system in such a manner that a selectable switch permits a normal defrost operation of several defrost cycles per day, or alternatively, just one energy saving defrost cycle per day.

17 Claims, 3 Drawing Figures

DEFROST TIMER HAVING SELECTABLE DEFROST TIME

BACKGROUND OF THE INVENTION

In the operation of household refrigerators, it has been common practice in the immediate past to automatically defrost the freezer unit as frequently as three, four, or six times a day to prevent frost buildup on the refrigeration unit. In many household refrigerators an electrical heater is energized to defrost the refrigeration unit. With recent efforts to minimize electrical power consumption it is considered to be undesirable to defrost a household refrigerator as frequently as in the past. Consequently, defrost control timers that produce fewer defrost cycles, such as one per day, are increasingly popular. Yet, there may be special, irregularly occurring circumstances that make it desirable to defrost the refrigerator more frequently than once a day. Additionally, because of inherent weather and atmospheric differences at various geographic locations, frequent defrosting may be required in some locations while less frequent defrostings may be acceptable in other locations. A single defrost control system that can be operated to selectively provide many or just one defrost operations in a given time period would be useful to meet the diverse requirements mentioned above. Furthermore, it is desirable to provide this selective defrosting capability with a minimum physical and electrical change in existing refrigeration and defrosting equipment.

BRIEF DESCRIPTION OF THE DRAWINGS

The invention will be described in connection with the accompanying drawings wherein.

DETAILED DESCRIPTION OF PREFERRED EMBODIMENT

Figure 1:
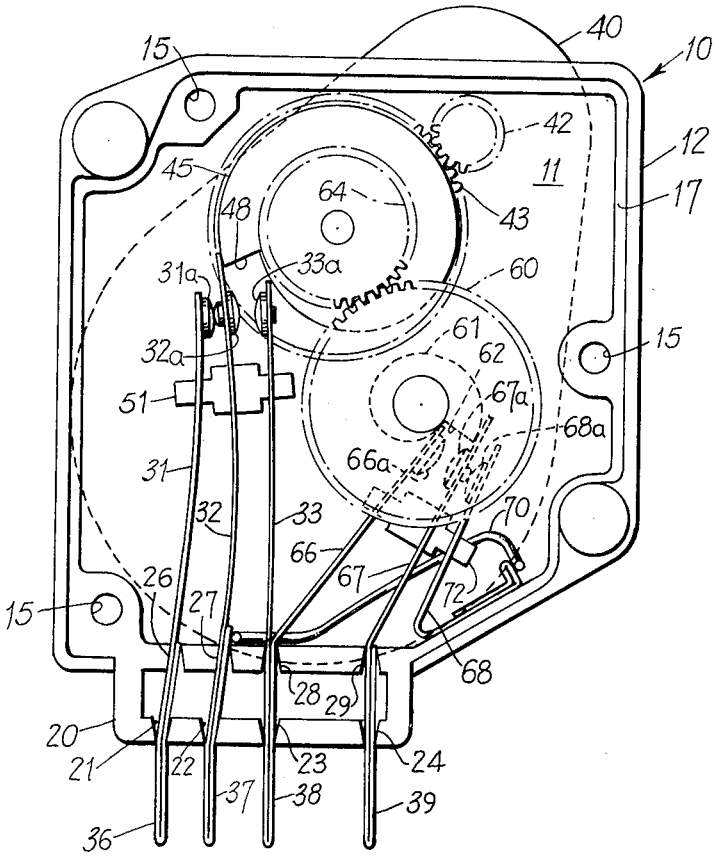
FIG. 1 is a plan view, partially in phantom, of a defrost timer device constructed in accordance with the teachings of this invention.

The defrost control unit of this invention is illustrated in FIG. 1 and includes a hollow housing or case 10 made of a plastic electrical insulating material. The case has a bottom wall 11 and a peripheral side wall 12. Case 10 includes apertures 15 that are molded therein. A flat cover, not illustrated, is shaped to rest on a recessed rim 17 that is on the inside of peripheral side wall 12. The cover, which may be translucent, is secured to case 10 by means of rivets or screws that pass through apertures 15. The cover and bottom wall 11 are parallel to each other to provide a timer cavity therebetween.

At the lower end of case 10, as viewed in FIG. 1, a U-shaped auxiliary wall 20 extends downwardly from the main body of the case and has slots 21, 22, 23, and 24 therein. Aligned slots 26, 27, 28, and 29 are in the bottom of peripheral side wall 12. Resilient, conductive, flat switch blades 31, 32, and 33 of a first timing switch are received edgewise in respective paris of slots 21–23 and 26–28. Each of the switch blades 31, 32, and 33 has a respective contact 31*a*, 32*a*, 32*i*, and 33*a* adjacent its free end. Contact 32*a* provides contact surfaces on both sides of switch blade 32. The switch blades 31, 32, 33 have respective plug-in terminals 36, 37 and 38 that extend downwardly from case 10.

A synchronous timer motor 40 of a type well known in the art is mounted on the back side of bottom wall 11. Bottom wall 11 has an aperture therein to permit the output pinion gear 42 of the timing motor to extend into the timer cavity of case 10. Pinion gear 42 drives a timing gear 43 that is secured to, attached to, or otherwise in fixed relationship to timing cam 45. Cam 45 has an increasing radius around a major portion of its circumference, and at a given angular position it has a single drop-off 48 back to the minimum radius.

The center switch blade 32 is longer than the blades 31 and 33 and will remain on the high portion of cam 45 a predetermined time after the blade 33 has fallen off the drop-off 48. All three switch blades 31, 32, and 33 are spring biased to tend to rotate their free ends in a clockwise direction as viewed in FIG. 1. The spring bias of center switch blade 32 is stronger than that of switch blade 33 so that their respective contacts 32*a* and 33*a* will be in contact with each other in the absence of the drop-off 48 forcing a separation between the two. As illustrated in FIG. 1, the spring bias of switch blade 31 is sufficient to bring its contact 31*a* into a making contact with the center contact 32*a* after switch blade 33 has dropped off drop-off 48 but the center switch blade 32 has not yet dropped off the drop-off 48. Insulator spacer 51 passes freely through center switch blade 32 and its respective ends are received in slots in the outside blades 31 and 33. Spacer 51 functions in the well known manner to assure that only one of the contacts 31*a* or 33*a* will be in contact with contact 32*a* at any given time.

During a major portion of the angular rotation of cam 45, switch blade 33 is riding on the periphery of cam 45 and contacts 32*a* and 33*a* are in contact with each other. During that time contact 31*a* is held in spaced relationship from contact 32*a* by insulator spacer 51. When blade 33 drops off the drop-off 48, as illustrated in FIG. 1, contacts 32*a* and 33*a* become separated and contacts 31*a* and 32*a* make electrical contact. After center switch blade 32 drops off the drop-off 48, contacts 32*a* and 33*a* again make with each other and spacer 51 functions to maintain switch blade 31 spaced from center switch blade 32 so that contacts 31*a* and 32*a* are open. Terminal 36 is connectable to the defrost heater, or some other defrost control means; terminal 37 is connectable to a source of electric power; and terminal 38 is connectable to the refrigeration compressor motor, or control means therefore.

The portion of the defrost timer described thus far is substantially identical to the commercially available model 499 household refrigeration defrost control of Paragon Electric Company, Inc., Two Rivers, Wis. This device is described in U.S. Pat. No. 3,501,608, issued Mar. 17, 1970.

In the example chosen for discussion here, it is assumed that timing gear 43 and timing cam 45 make one complete revolution in 8 hours of running time of synchronous motor 40. Consequently, switch blades 31, 32, and 33 will go through three defrost switching cycles each day. Other cycle times are available in defrost timers of this type.

In accordance with the present invention, a second timing gear 60, a second timing cam 61, and a second timing switch comprised of switch blades 66, 67, and 68 are included in the timer cavity of case 10. The second timing cam 61 is illustrated as having an increasing radius, except for the single drop-off 62. The free ends of switch blades 66 and 67 of the second timing switch operate in cooperation with cam 61 in a manner similar to the operation of the first timing switch and first timing cam 45. Switch blades 66, 67, and 68 carry respective contacts **66*a*, 67*a*, and 68*a*. Contact 67*a* provides contact surfaces on both sides of center blade 67. An insulator spacer 72 performs the same function on the second switch that the spacer 51 performs on the first switch. The second timing gear 60 is driven by an intermediate gear 64 that is located above and rotates with timing cam 45. In practice, timing cam 45 and intermediate gear 64 may be a unitary structure molded from plastic. Similarly, the second timing gear 60 and second timing cam 61 are in different elevations and preferably are molded as a unitary plastic structure. As illustrated in FIG. 1, second timing cam 61 is below the second timing gear 60 so that the two cams 45 and 61 are at substantially the same elevation above bottom wall 11. This permits all of the switch blades 31, 32, 33, and 66, 67, 68** to be at a common level, thereby avoiding the requirement for complicated compound bends in any of the switch blades.

As seen in FIG. 1, switch blades 33 and 66 are electrically connected together at their common terminal 38. A jumper wire 70 electrically connects switch blades 32 and 68 of the two switches. Alternatively, a formed clip located in or above the space between the auxiliary wall 20 and peripheral wall 12 may be used to electrically connect terminals 37 and 68.

In the example described here, the relationship between intermediate gear 64 and the second timing gear 60 is chosen so that the second timing gear 60 makes two-thirds of a revolution each complete revolution of intermediate gear 64. Accordingly, first timing cam 45 makes one complete revolution in 8 hours and second timing cam 61 makes one complete revolution in 12 hours. As will be explained below, other timing relationships may be provided by the gears.

As is well understood by those skilled in the art, times discussed herein are referenced to the running time, or energization time, of synchronous motor 40. In some defrost control systems the timer motor is continuously energized. In other systems, the timer motor is energized only when the contacts of the cold control thermostat are closed. In this latter situation, the energization time is sometimes called "compressor run time". As will be seen below in connection with FIG. 2, the system illustrated and discussed is of this latter type. Consequently, when speaking of elapsed time and time periods, it is to be understood that because of the example assumed, the time is referenced to energization time of the synchronous motor 40. In the accompanying claims, the time periods are in relation to the times of energization of the timer motor, whether it is continuous or intermittent.

An example of the mechanical timer and switching unit having been described above, its use in defrost control circuitry now will be described.

Figure 2:
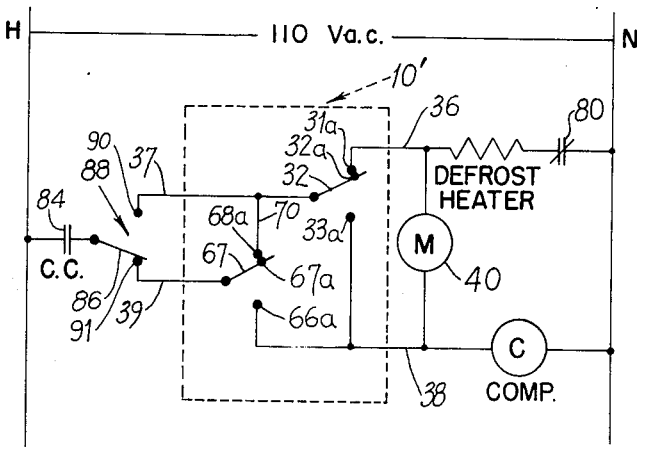
FIG. 2 is a simplified electrical diagram illustrating the portion of a domestic refrigerator defrost system that employs the present invention.

FIG. 2 illustrates in simplified form that portion of a household refrigerator defrost control system employing the present invention. The control system is connected between the hot and neutral conductors H and N of a 110 volt a.c. power supply. The electrical portion of the defrost timer of FIG. 1 is schematically illustrated within the broken line rectangle 10' of FIG. 2. Terminal 36 of the timer is directly connected to the defrost heater. Defrost thermostat 80 connects the heater to neutral conductor N. The contacts of defrost thermostat 80 are normally closed. They open at a predetermined high temperature within the refrigerator to terminate defrost heating.

Terminal 38 of the defrost timer device is connected to the compressor motor of the refrigeration unit. Alternatively, terminal 38 could be connected to some control means for the compressor motor.

Timing motor 40 that drives pinion gear 42, FIG. 1, is connected between terminals 36 and 38.

The contacts 84 of the cold control thermostat of the refrigerator are connected between the hot conductor H of the power supply and the movable contact 86 of a manual selector switch 88. The stationary contacts 90 and 91 of manual selector switch 88 are respectively connected to terminals 37 and 39 of the defrost control unit of FIG. 1.

The center switch blade 32 of the first timing switch is illustrated in FIG. 2 as the movable contact that switches between contacts **31*a* and 33*a* and is connected both to terminal 37 and by way of jumper wire 70 to the contact 68*a* of the second timing switch. Center switch blade 67 of the second timing switch is illustrated in FIG. 2 as the movable contact between contacts 66*a* and 68*a*. Center switch blade 67 is connected to the stationary contact 91 of manual selector switch 88**.

Considering the operation of the system illustrated in FIG. 2, it is seen that when the movable contact arm 86 of manual selector switch 88 is in its upper position in contact with stationary contact 90, the second timing switch comprised of contacts **66*a*, 67*a*, and 68*a* is effectively out of the circuit. The defrost control system now is under exclusive control of the first timing switch comprised of contacts 31*a*, 32*a*, and 33*a*. These contacts are associated with first timing cam 45** that makes one complete revolution each 8 hours, i.e., three defrost cycles per day. This is a normal defrost mode as presently performed by currently available defrost timers of the type mentioned above.

In this normal mode of operation, contacts **32*a* and 33*a* are closed during a major portion of the revolution of cam 45. Spacer 51 keeps contact 31*a* spaced from contact 32*a*. This is the refrigeration mode during which the compressor is energized when contacts 84 of the cold control thermostat are closed. When blade 33 drops off the drop-off 48 contacts 32*a* and 33*a* open and contacts 31*a* and 32*a* close to energize the defrost heater. The heater remains energized as long as center switch blade 32 is on the high portion of the cam 45. This defrost period typically is 20 to 25 minutes. When center blade 32 drops off drop-off 48, contacts 32*a* and 33*a* again make and contacts 31*a* and 32*a*** open. The system now is back in the refrigeration mode.

When movable contact 86 of manual selector switch 88 is moved to its downward position into contact with stationary contact 91, as illustrated in FIG. 2, the second timing switch comprised of contacts **66*a*, 67*a*, and 68*a* is connected into the system. This is the energy saving mode of operation. It now may be seen that the defrost heater may be energized only when center contact 32*a* of the first timing switch is in contact with contact 31*a*, and center contact 67*a* of the second timing switch is in contact with contact 68*a*. Referring to FIG. 1 it is seen that this switching combination occurs only when both switches are in the same condition (illustrated in FIG. 1) wherein both of the first switch blades 33 and 66 have fallen off their respective drop-offs 48** and 62 but the two longer center blades 32 and 67 still are on the high portions of their respective cams.

With the timing relation described above for the two timing cams, cams 45 and 61 will arrive simultaneously at the positions illustrated in FIG. 1 once each 24 hours of operation of timer motor 40. This relationship is demonstrated in simplified form in FIG. 3 wherein the dots on the two right hand linear time scales represent the times that each of the cam drop-offs 48 and 62 is at the angular position illustrated for it in FIG. 1. It is seen that cam 45 arrives at its predetermined angular position three times each 24 hours and cam 61 arrives at its predetermined position just twice each 24 hours. The two cams are simultaneously at their predetermined angular positions just once each 24 hours of operation of timer motor 40. In the interim period, when one of the cams is at its predetermined angular position the other one if not, and vice versa. Referring to FIGS. 1 and 2, in each 24 hour period of energization of motor 40, two out of the three times that contacts 32*a* and 31*a* of the first timing switch are making contact, the contact 67*a* of the second timing switch is in contact with contact 66*a*. It is seen that the defrost heater cannot be energized with this switching arrangement. Also, once out of the two times that contacts 67*a* and 68*a* are closed on the second switch, contact 31*a* and 32*a* on the first switch are open. Again, the defrost heater cannot be energized with that arrangement.

The gears and cams associated with the two timing switches are so arranged that when the cams 45 and 61 both are at their predetermined angular positions at the same time, cam 61 will be positioned to cause switch blade 66 to drop off its drop-off 62 just slightly earlier than switch blade 33 drops off its drop-off 48. Similarly, the length of center switch blades 32 and 67 are such that blade 32 will drop off its drop-off 48 just slightly earlier in time than will the center switch blade 67 drop off its drop-off 62. This arrangement assures that timing cam 45 and its corresponding first timing switch will control initiation and termination, if necessary, of the defrost cycle with the same precision irrespective of whether the defrost system is in its once-a-day defrost mode (energy saver mode) or in its three-times-a-day defrost mode (normal mode).

Considering the operation of the compressor during the cycling of the two timing switches, assuming that selector switch 88 is in the position illustrated in FIG. 2 and that the contacts 84 of cold control thermostat are closed, when contacts 66*a* and 67*a* of the second switch are closed the compressor is connected directly between the hot and neutral supply conductors regardless of the positions of the contacts 31*a*, 32*a*, and 33*a* of the first timing switch. When switch blade 66 drops off its drop-off 62 so that contacts 67*a* and 68*a* of the second timing switch are closed, contacts 32*a* and 33*a* of the first timing switch will be closed at all times except when defrosting is supposed to take place.

Therefore, the compressor is energized by way of the hot conductor H, closed contacts 84 of the cold control thermostat, movable contact 86 of the selectable switch 88, contacts 67*a* and 68*a* of the second timing switch, contacts 32*a* and 33*a* of the first timing switch, to the compressor and to the neutral conductor N.

In a typical defrost control system of the type illustrated in simplified form in FIG. 2 the defrost heater will have an impedance of approximately 30 ohms, the compressor motor will have an impedance of the order of 2.5 ohms, and the timer motor 40 will have an impedance of the order of 800 ohms. Timer motor 40 is energized except when contact 84 of the cold control thermostat are open and except when the contacts of defrost thermostat 80 are open and the switches are set for refrigeration system for a household refrigerator. The remaining portions of such a system, such as fans, etc., are not included in FIG. 2 since they form no part of the present invention. As mentioned above, other types of systems also are known.

Figure 3:
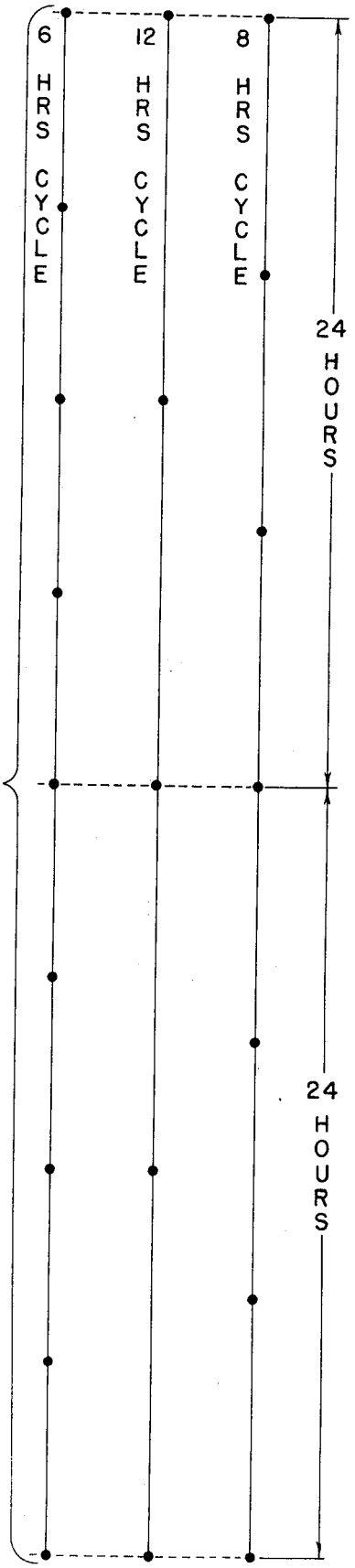
FIG. 3 is a simplified representation of the time cycling of several timing cams that are used, or could be used, in the apparatus illustrated in FIG. 1.

The left hand time scale in FIG. 3 illustrates the cycling of an alternative second timing cam that would complete one revolution in just 6 hours of running time. Such a cam would complete four revolutions in a 24 hour period, but its cam drop-off could be at its respective predetermined angular position (illustrated by dots on the time scale) simultaneously with that of the first timing cam 45 just once in that given 24 hour period.

In the above example, both timing cams have a single drop-off, i.e., they are single lobe cams. Obviously, multiple lobe cams may be employed if desired. Furthermore, other arrangements of gears could be employed. The illustrated arrangement presently is preferred because the housing 10, timing motor 40, first timing gear 43, first timing cam 45, and first timing switch are substantially the same as that used in the prior art defrost timers mentioned above. Consequently, tooling and manufacturing costs for the selectable defrost timers of this invention are minimized.

The discussion above was based on a basic timing period of 24 hours, and time cycles of 8, 12, and 6 hours (FIG. 3) for the timing cams. It will be obvious that a variety of different time periods and time cycles may be selected in practicing the teachings of this invention. A general expression for the speed ratio Rr between the first and second timing cams is as follows.

$$Rr = \frac{Sf}{Ss} = \frac{1}{(2 - N)(1 - De/Dn) - 2(1 - N)(De/Dn)}$$

where:

$Sf$ = speed of revolution of first timing cam
$Ss$ = speed of revolution of second timing cam
$De$ = number of energy saving defrosts per time period T
$Dn$ = number of normal defrosts per time period T
$T$ = basic time period, usually 12 or 24 hours
$N$ = number of lobes on the first cam Typically the values of T, N, De and Dn will be given to the designer of the timer. Once these quantities are given, the time for one normal defrost cycle of the first timing cam $C_T$ may be expressed as $$C_T = T/Dn \text{ hours,}$$

and the speed of revolution of the first timing cam may be expressed as $$Sf = \frac{1}{C_T N} \text{ revolutions per hour.}$$

The above expression for the speed ratio Rr is usable within the limits $De/Dn = \frac{1}{2}, \frac{1}{3}, \frac{1}{4}$, and 1/5 and for the limitation that $N = 1$ or 2.

In its broader aspects, this invention is not limited to the specific embodiment illustrated and described. Various changes and modifications may be made without departing from the inventive principles herein disclosed.

What is claimed is:

1. In a defrost control system having a defrost heater for defrosting a refrigeration means and compressor means for use in cooling said refrigeration means, defrost timer means selectively operable to defrost the refrigeration means one or more times each given time period, the combination comprising first and second supply lines connected to an electrical source, means for connecting one terminal of the defrost heater to the first supply line, means for connecting one terminal of the compressor means to said first supply line, a defrost timer device having at least four terminals, first and second switch means included in said defrost timer device and each being operable between first and second switch positions, first and second rotatable cam means each associated with a respective switch means for operating the respective switch means from its first to its second switch position when a given part of the cam is at a respective predetermined angular position, means for rotating the two cam means a respective number of times each given time period to cause the respective given parts of the two cams to simultaneously arrive at their predetermined angular position only once each given time period, means interconnecting the two switch means for providing a series conduction path therethrough between the first and fourth terminals of the defrost timer when both switch means are in their second switch positions, means including a selectable switching means which in one switching position provides a series conduction path from the other supply line through the fourth terminal of the defrost timer and through the second switch means in its first switch position to the other terminal of the compressor, and when in its other switching position provides a series conduction path from the other supply line through the third terminal of the defrost timer and through the first switch means in its second switch position to the other terminal of the defrost heater, and means for connecting said other supply line to the other terminal of the compressor means when the selectable switching means is in its other switching position and the first switch means is in its first switch position.

2. The combination claimed in claim 1 wherein the first and second cams and their respective first and second switch means are constructed and arranged so that the second switch means transfers to its second switch position before the first switch means when both cams simultaneously are arriving at or near their predetermined angular positions.

3. The combination claimed in claim 2 wherein the first switch means transfers from its second switch position back to its first switch position before the second switch means after the cams have arrived at their predetermined angular positions.

4. In a defrost control system having a defrost heater for defrosting a refrigeration means and compressor means for use in cooling said refrigeration means, defrost timer means selectively operable to defrost the refrigeration means one or more times each given time period, the combination comprising first and second supply lines connected to an electrical source, means for connecting one terminal of the defrost heater to the first supply line, means for connecting one terminal of the compressor means to said first supply line, a defrost timer device having at least four terminals, first and second switch means included in said defrost timer device, each switch having three contacts, the second contact selectively making contact with the first and third contacts, respectively, when in first and second switch positions, first and second rotatable cam means each associated with a respective switch means for operating the respective switch means from said first to said second switch position when a given part of the cam is at a respective predetermined angular position, means for rotating the two cam means to cause the respective given parts of the two cams to rotate a different number of times each given time period and to simultaneously arrive at their predetermined angular position only once each given time period, means interconnecting the two switch means for providing a series conduction path therethrough between the first and fourth terminals of the defrost timer when both switch means are in their second switch positions, means including the first and second defrost timer terminals for respectively connecting the third and first contacts of the first switch means to the other terminal of the defrost heater and to the other terminal of the compressor means, means for connecting the third contact of the second switch means to the second contact of the first switch means and to the third terminal of the defrost timer, means for connecting together the first contacts of the two switch means, and means including selector switch means for selectively connecting the third or fourth terminal of the defrost timer to the other supply line.

5. In a defrost control system having a defrost heater for defrosting a refrigeration means and compressor means for use in cooling said refrigeration means, defrost timer means selectively operable to defrost the refrigeration means one or more times each given time period, the combination comprising first and second supply lines connected to an electrical source, means for connecting one terminal of the defrost heater to the first supply line, means for connecting one terminal of the compressor means to said first supply line, a defrost timer device having at least four terminals, first and second switch means included in said defrost timer device, first and second rotatable cam means each associated with a respective switch means for operating the respective switch means from a first to a second switch position when a given part of the cam is at a respective predetermined angular position, means for rotating the two cam means a different number of times each given time period to cause the respective given parts of the two cams to simultaneously arrive at their predetermined angular position only once each given time period, each switch having three contacts, the second contact selectively making contact with the first and third contacts, respectively, when in said first and second switch positions, means including two of the defrost timer terminals for respectively connecting the first and third contacts of the first switch means to the other terminal of the compressor means and to the other terminal of the defrost heater, means for connecting the first contact of the second switch to the first contact of the first switch, means for connecting the second contact of the first switch to a third terminal of the defrost timer and to the third contact of the second switch, means for connecting the second contact of the second switch to the fourth terminal of defrost timer, means including selectable switch means for selectively connecting the third or fourth terminal of the defrost timer to the other supply line.

6. In a selectable cycle defrost control system having a defrost heater for defrosting a refrigeration means and a compressor means for use in cooling said refrigeration means, the combination comprising first and second supply lines connected to an electrical source, means for connecting one terminal of the defrost heater to the first supply line, means for connecting one terminal of the compressor means to said first supply line, a selectable cycle defrost timer for controlling said heater and compressor, said timer including a housing, said housing having top and bottom walls and a peripheral side wall therebetween, a first timing cam in said housing adapted to rotate about an axis transverse to said top and bottom walls, gear means for rotating said timing cam in response to rotation of a motor, first switch means in said housing cooperating with said timing cam to transfer from a first to a second switch position when a given part of the timing cam is at a predetermined angular position, terminal means for said first switch means extending through said housing, a second timing cam in said housing adapted to rotate about an axis transverse to said top and bottom walls, second gear means for rotating said second timing cam in response to said motor, second switch means in said housing cooperating with the second timing cam to switch from a first to a second switch position when a given part of the cam is at a respective predetermined position, second terminal means for the second switch extending through said housing, said two terminal means including at least four terminals, said gear means and the two timing cams being so constructed and arranged to cause said cams to transfer the two switches from their first to their second switch positions a different number of times each given time period and said given parts of the two cams simultaneously being at their respective predetermined angular positions only once each given time period, means interconnecting the two switch means for providing a series conduction path therethrough between the first and fourth terminals of the defrost timer when both switch means are in their second switch positions, means including a selectable switch means which in one switching position provides a series conduction path from the other supply line through the fourth terminal of the defrost timer and through the second switch means in its first switch position to the other terminal of the compressor, and when its other switching position provides a series conduction path from the other supply line through the third terminal of the defrost timer and through the first switch means in its second switch position to the other terminal of the defrost heater, and means for connecting said other supply line to the other terminal of the compressor means when the selectable switching means is in its other switching position and the first switch means is in its first switch position.

7. In a defrost timer for controlling the defrosting of a refrigeration means wherein the timer includes a timing cam that is rotatable by drive means that includes motor means, and which further includes switch means cooperating with said timing cam for switching from a first to a second switch position when a given part of the cam is at a predetermined angular position, and wherein the timer includes a plurality of terminal means connected to the switch means, the improvement comprising a second timing cam, means coupled to said motor means for rotating the second timing cam a different number of times than the first named cam each given time period, second switch means cooperating with said second cam to transfer from a first to a second switch position when a given part of the second cam is at a respective predetermined angular position, additional terminal means associated with said second switch means, means interconnecting the two switch means for providing a series connection between a designated pair of terminal means of the two switch means only when the two switch means are in their second switch positions at the same time, each of said switches having three contacts, the second contact making contact with the first and third contacts, respectively, when in first and second switch positions, and means for connecting the first contacts of both switch means to a common one of said terminal means that is other than one of said designated pair of contacts.

8. The combination claimed in claim 7 wherein the first and second cams and their respective first and second switch means are constructed and arranged so that the second switch means transfers to its second switch position before the first switch means when both cams simultaneously are at or near their predetermined angular positions.

9. The combination claimed in claim 8 wherein the first switch means transfers from its second switch position back to its first switch position before the second switch means after the cams have arrived at their predetermined angular positions.

10. In a defrost timer comprised of a housing having spaced top and bottom walls and a peripheral side wall for defining a timer cavity therebetween, and wherein a timing cam in said cavity is rotatable by drive means that includes motor means, and further including switch means in the cavity cooperating with said timing cam for switching from a first to a second switch position when a given part of the cam is at a predetermined angular position, and wherein the timer includes a plurality of terminal means connected to the switch means and extending through the housing, the improvement comprising a second timing cam in said cavity, means coupled to said motor means for rotating said second cam at a given speed relative to said first named cam, second switch means in said housing and cooperating with said second cam for transferring from a first to a second switch position when a given part of the second cam is at a respective predetermined angular position, additional terminal means associated with said second switch means and extending through said housing, means interconnecting said two switch means for providing a series connection between a designated pair of terminal means only when the two switch means are in their second switch positions at the same time.

11. The defrost timer claimed in claim 10 wherein said two switch means transfer from their first to their second switch positions a different number of times each given time period and said given parts of the two cams are simultaneously at their respective angular positions just once each given time period.

12. A selectable cycle defrost timer comprising a housing, said housing having top and bottom walls and a peripheral side wall therebetween, a first timing cam in said housing adapted to rotate about an axis transverse to said top and bottom walls, gear means for rotating said timing cam in response to rotation of a motor, first switch means in said housing cooperating with said timing cam to transfer from a first to a second switch position when a given part of the timing cam is at a predetermined angular position, terminal means for said first switch means extending through said housing, a second timing cam in said housing adapted to rotate about an axis transverse to said top and bottom walls, second gear means for rotating said second timing cam in response to said motor, second switch means in said housing cooperating with the second timing cam to switch from a first to a second switch position when a given part of the cam is at a respective predetermined position, second terminal means for the second switch extending through said housing, said gear means and the two timing cams being so constructed and arranged to cause said cams to transfer the two switches from their first to their second switch positions a different number of times each given time period and said given parts of the two cams simultaneously being at their respective predetermined angular positions only once each given time period.

13. The selectable cycle defrost timer claimed in claim 12 wherein said motor, said gear means and said cams are so constructed and arranged that the ratio Rr between the speeds of rotation of the first and second cams approximately satisfies the relationship $$Rr = \frac{1}{(2 - N)(1 - De/Dn) - 2(1 - N)(De/Dn)}$$

where $N$ equals the number of lobes (given parts) on the first timing cam, $De$ equals the first selectable number of defrost cycles desired in a given time period (energy saving defrosts), and $Dn$ equals the second selectable number of defrost cycles desired in a given time period (normal defrosts).

14. The selectable cycle defrost timer claimed in claim 12 wherein said second timing cam rotates on an axis parallel to and displaced from the rotational axis of the first timing cam.

15. The selectable cycle defrost timer claimed in claim 12 wherein said terminal means extend through the peripheral wall of the housing.

16. The selectable cycle defrost timer claimed in claim 12 wherein at least one of said timing cams has more than one given part thereon for transferring its corresponding switch means to its second switch position.

17. The selectable cycle defrost timer claimed in claim 8 wherein at least one of said switches comprises first, second, and third thin, flexible switch blades of conductive material, means associated with said housing for supporting each switch blade at or near one end thereof, at least some of said terminal means being associated with the supported ends of the switch blades, contact means associated with the free end of each switch blade, means cooperating with said switch blades for permitting only two of said contacts to contact each other at any time.

* * * * *